United States Patent [19]

Lin

[11] 4,427,862

[45] Jan. 24, 1984

[54] CONTACT ASSEMBLY FOR A HIGH-VOLTAGE CIRCUIT INTERRUPTER

[75] Inventor: Chester H. Lin, Skokie, Ill.

[73] Assignee: S&C Electric Company, Chicago, Ill.

[21] Appl. No.: 439,688

[22] Filed: Nov. 8, 1982

[51] Int. Cl.[3] ..... H01H 9/38

[52] U.S. Cl. ..... 200/252; 200/146 R; 200/260

[58] Field of Search ..... 200/252, 257, 260, 163, 200/146 R

[56] References Cited

U.S. PATENT DOCUMENTS

| | | | |
|---|---|---|---|
| 2,376,818 | 5/1945 | Rubel | 200/163 X |
| 2,806,926 | 9/1957 | Rigert et al. | 200/257 X |
| 3,551,629 | 12/1970 | Berg | 200/257 |

FOREIGN PATENT DOCUMENTS

| | | | |
|---|---|---|---|
| 2935202 | 3/1981 | Fed. Rep. of Germany | 200/163 |

*Primary Examiner*—John W. Shepperd
*Assistant Examiner*—Renee S. Kidorf
*Attorney, Agent, or Firm*—John D. Kaufmann

[57] ABSTRACT

A female contact of an interrupter includes a number of flexible fingers in a cylindrical array defining a cavity toward the axis of which the fingers are biased. A pair of semi-annular refractory members are located at the free ends of the fingers and define a passageway which is continuous with the cavity. The members are not welded or brazed to the fingers and are, accordingly, transversely free-floating relative to the fingers; they can move laterally of the axis independently of the fingers, but are prevented from movement along the axis. When a male contact is out of the cavity and the passageway, the fingers act against the exterior of the members until facing stop surfaces on the members abut, setting the minimum size of the passageway, which is smaller than the diametric size of the male contact but larger than the diametric size of the cavity between contact buttons on the fingers. When the male contact is in the passageway, the stop surfaces separate and the fingers bias the members so that the wall of the passageway intimately, slidingly engages the male contact. When the male contact is in the cavity the buttons intimately engage it, and outward flexing of the fingers disengages them from the members.

20 Claims, 10 Drawing Figures

CONTACT ASSEMBLY FOR A HIGH-VOLTAGE CIRCUIT INTERRUPTER

BACKGROUND OF THE INVENTION

1. Field of the Invention

The present invention relates to an improved contact assembly for a high-voltage circuit interrupter and, more particularly, to an improved female contact for a high-voltage circuit interrupter protecting an alternating-current circuit, which female contact is simpler to manufacture and lower in cost than prior art female contacts and exhibits longer life and greater resistance to damage caused by sustained high-voltage arcing within the interrupter.

2. Brief Discussion of the Prior Art

High-voltage circuit interrupters, such as circuit switchers and other puffer-type interrupters, are well known in the prior art. These circuit interrupters typically comprise normally engaged main contacts and normally engaged arcing (or interrupting) contacts. When the interrupter is closed, current may pass between the engaged main contacts. When a fault current or other overcurrent in a circuit protected by the interrupter is sensed by appropriate detectors, the main contacts are opened in response thereto. In order to "protect" the main contacts, that is, in order to prevent arcing therebetween, a current path is established between the arcing contacts before the main contacts separate. Thus, no arcing occurs between the main contacts. Following separation of the main contacts, the arcing contacts separate and arcing is initiated therebetween. As the interrupter is closed, the arcing contacts engage before the main contacts engage. The arcing contacts are typically made of a refractory metal in order to withstand the numerous arcing events which may occur during opening and closing of the circuit interrupter. Since the arcing contacts are not relied upon to provide the normal current path through the interrupter, any "damage" that they do sustain as a result of arcing events does not effect the ability of the interrupter to carry current, which ability results from the "protection" of the main contacts, as described.

Whether comprising main contacts or arcing contacts, a typical prior art contact structure comprises a female contact and a male contact. When the main contacts are closed, they engage, with the male contact being telescoped into the female contact. When the contacts separate to open, the male contact moves out of the female contact and away therefrom. Often, the main contacts and the arcing contacts of high-voltage circuit interrupters each comprise a male-female contact pair, with each pair being mechanically related to the other pair so that there is some "overlap" between the opening and closing thereof. This "overlap" permits the main contacts to separate prior to separation of the arcing contacts during opening of the interrupter and permits the arcing contacts to engage prior to engagement of the main contacts during closing of the interrupter.

The cost of high-voltage circuit interrupters is lowered if, instead of using two male-female contact pairs, a single male-female contact pair functions as both the main contacts and the arcing contacts. Obviously, the elimination of one contact pair also simplifies the circuit interrupter. To these ends, the male contact has included an elongated, conductive rod carrying a refractory tip at the free end thereof, and the female contact has included a cylindrical array of flexible, conductive, spaced fingers which define a cavity into and out of which the male contact may be telescoped. The fingers are biased inwardly toward the axis of the cavity. Free ends of the fingers carry refractory tips which define therebetween an aperture continuous with the cavity. When the contacts are closed and the male contact is within the cavity, current passes between the engaged rod and fingers acting, therefore, as the main contacts. As the contacts open, the rod "leads" the tip thereon in exiting the cavity and the aperture. At some point during this exiting after the main contacts—the rod and the finger—separate, the tip on the rod and the tips on the fingers engage, the engaged tips, therefore, momentarily carrying the current in the interrupter and act as the arcing contacts. Finally, the arcing contacts—the refractory tips—separate and high-voltage arcing is initiated therebetween. As the contacts close, engagement of the tips "leads" engagement of the rod and the fingers so that any arcing occurs between the tips.

In typical prior art female contacts of the type described above, the refractory tips are brazed or welded to the free ends of the fingers. The female contact has been fabricated by brazing or welding a refractory metal ring to one end of a metal tube and thereafter forming a series of parallel, elongated cuts or slits in the ring and the tube to define the plurality of fingers with the refractory tips on the free ends of each thereof. The female contact has also been fabricated by first forming the fingers in any convenient manner and then welding or brazing individual tips to the free ends thereof.

Several deficiencies have been noted in the above-described female contacts of the prior art. First, the brazing or welding of the refractory ring or tips to the conductive tube or the fingers increases manufacturing costs. Second, during operation of an interrupter containing the prior art female contact, sustained arcing to one finger or its tip may degrade or destroy the brazing or weldment between the tip and its finger, causing the tip to become dislocated. Dislocation of the tip may jam the circuit interrupter by interferring with the free relative movement (during opening or closing) of the contacts. Third, sustained arcing to one finger or its tip is encouraged when the female contact is constructed, as described above, that is, where the fingers and their tips are spaced apart or are formed by the parallel cuts or slits. Specifically, the spacing of the fingers and their tips (whether produced by the cuts or slits, or otherwise) provides sharp edges or corners on which a high-voltage arc may "root" or preferentially terminate. Such rooting of an arc may result in undue heating of the finger and its tip leading to the possible result that the brazing or weldment therebetween will be degraded or destroyed and that dislocation of the tip occurs.

As a consequence of the above, a primary object of the present invention is the provision of improved contact structure for a high-voltage circuit interrupter in which the main contacts and the arcing contacts constitute a single male-female contact pair, and in which the structure of the female contact is improved to obviate or eliminate the above-described problems and difficulties inhering in prior art female contacts.

SUMMARY OF THE INVENTION

With the above and other objects in view, the present invention relates to an improved female contact for a circuit interrupter. The interrupter includes a male contact, which comprises an elongated, conductive rod having a refractory free end. The male contact is telescoped into or out of the female contact when the contacts are relatively moved along coincident, longitudinal axes thereof. The female contact includes an array of conductive, parallel, elongated, flexible fingers. The fingers define a male-contact-receiving cavity. The fingers are biased toward the axis of the cavity.

The improved female contact has at least two refractory members located in the vicinity of free ends of the fingers. The refractory members define therebetween a male-contact-engaging passageway which is continuous with the cavity. The outside of each member is engageable by the free end of at least one finger. The members are not attached to, are free floating relative to, and are independently movable with respect to the fingers. In preferred embodiments, the number of refractory members is two, and the outside of each is engageable by the free ends of one-half of the fingers.

The refractory members each include a pair of lateral stop surfaces. Each stop surface on each member faces a respective stop surface on an adjacent member. Abutment of the facing stop surfaces, which occurs due to the engagement of the fingers with the exterior of the members when the male contact is out of the cavity and the passageway, sets the extent of maximum movement of the members toward the axes.

Facilities are provided for preventing movement of the refractory members along or parallel to the axes, while nevertheless permitting the members to move laterally of the axes independently of the fingers. Thus, the refractory members are prevented from longitudinal movement along the axes, but are permitted to be "free floating" laterally of the axes relative to the fingers.

Each finger includes a male-contact-engageable conductive contact site within the cavity. Each site may constitute a button, rivet, or other protrusion on each finger, remote from the free end thereof. Each contact site extends toward the axes. When the male contact is not within the cavity or the passageway and the stop surfaces abut, the diametric size of the cavity defined between the sites is smaller than the diametric size of the passageway. When the male contact is in the cavity and engages the sites, the sites are moved away from the axes so that the diametric size of the cavity defined between the sites is substantially equal to or is smaller than the diametric size of the passageway.

When the male contact is out of the cavity and the passageway, the facing stop surfaces of the refractory members abut due to the action against the exterior thereof of the biased fingers. The size of the passageway defined by the refractory members at this point is smaller than the diametric size of the male contact so that, upon entry of the male contact into the passageway, intimate sliding engagement between the wall of the passageway and the male contact is effected. Upon further telescoping of the male contact into the female contact, the male contact is intimately, slidingly engaged by the contact sites. Because of the difference in diametric size of the cavity between the contact sites and of the passageway, there results positive mechanical and electrical engagement between the contact sites and the male contact without relying upon the refractory members. Upon withdrawal of the male contact from the cavity, the male contact ultimately moves past the contact sites and reaches the passageway. At this point again, the fingers cause the wall of the passageway to be in good, sliding engagement with the male contact so that, as the contacts separate, any arcing which occurs is initiated between the refractory end of the male contact and the refractory members.

DETAILED DESCRIPTION

The present invention relates to an improved female contact 10 which may conveniently be used in a high-voltage circuit interrupter. The circuit interrupter, as such, is not shown in the FIGURES, only so much thereof being shown as to illustrate the principles of the present invention. The improved female contact 10 of the present invention may be used with the high-voltage circuit interrupters disclosed in commonly-assigned co-pending United States patent application, Ser. No. 235,333, filed Feb. 17, 1981 in the names of Hall and Jarosz; and in the following commonly assigned U.S. Pat. Nos.: 4,324,959 issued Apr. 13, 1982 in the names of Hall and Opfer; 4,352,437 issued Oct. 5, 1982 in the name of Bernatt; 4,203,083 issued May 13, 1980 in the names of Opfer and Votja; and 4,241,248 issued Dec. 23, 1980 in the name of Bernatt; 4,103,121 issued July 25, 1978 in the names of Rogers and Swanson; 4,103,120 issued July 25, 1978 in the names of Jarosz and Swanson; 3,896,282 issued July 22, 1975 in the name of Chabala; 3,769,477 issued Oct. 30, 1973 in the names of Chabala and Rogers; 3,508,178 issued Apr. 21, 1970 in the names of Chabala and Rogers; 3,508,022 issued Apr. 21, 1970 in the name of Chabala; 3,345,473 issued Oct. 3, 1967 in the names of Chabala and Rogers; 3,339,037 issued Aug. 29, 1967 in the names of Bernatt and Rogers; 3,268,696 issued Aug. 23, 1966 in the name of Lindell; and 3,244,826 issued Apr. 5, 1966 in the name of Lindell.

Figure 1:
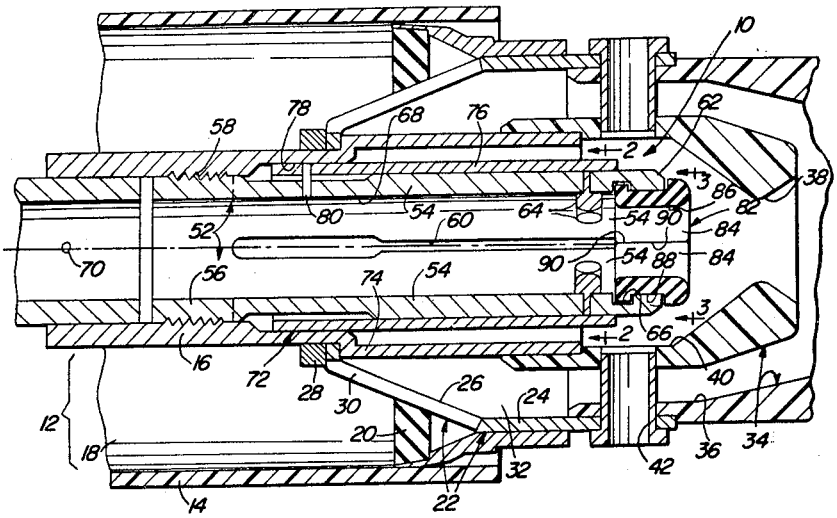
FIG. 1 is a sectioned, side elevation of an improved female contact according to the present invention.
Figure 5:
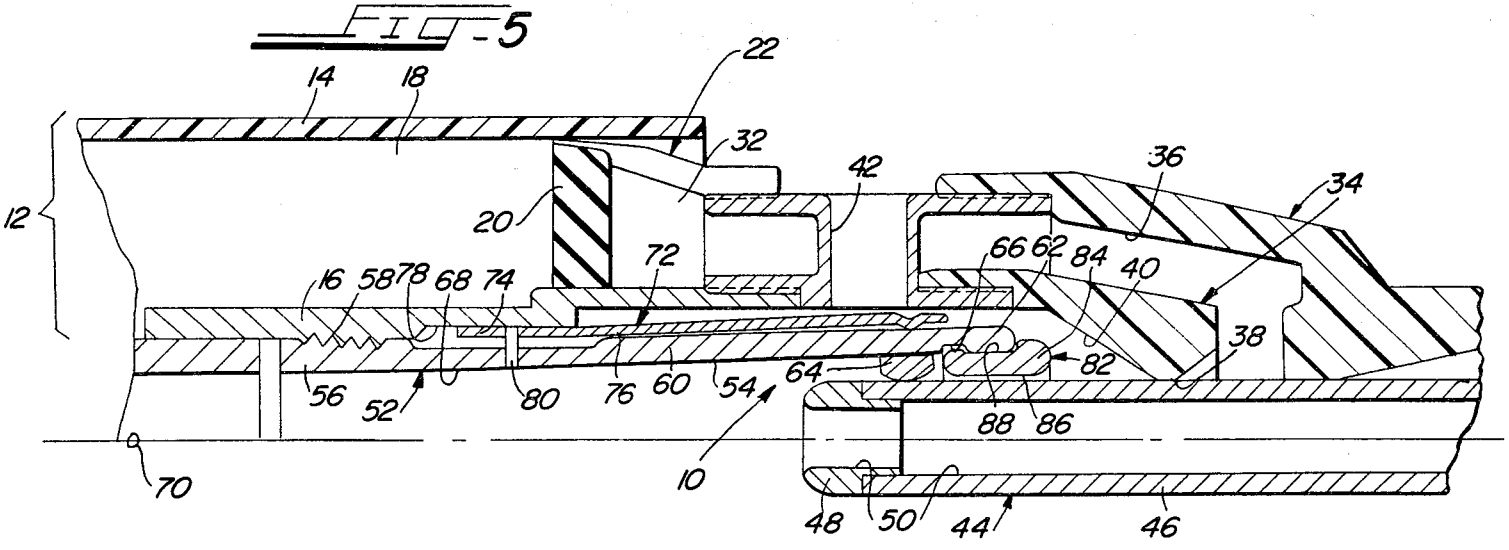
FIG. 5 is a sectioned, partial, side elevation of the improved contact depicted in FIG. 1 at a time when this contact is engaged with a male contact, the two contacts being contained in a high-voltage circuit interrupter.
Figure 7:
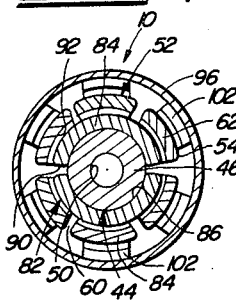
FIG. 7 is an end sectional view taken along line 7—7 in FIG. 6 showing in greater detail the improved contact of that FIGURE.

Referring to FIGS. 1 and 5, contained within an outer insulative housing (not shown) of the circuit interrupter is a pump 12. The pump 12 comprises an outer cylinder 14, which may be made of a conductive or an insulative material, and an inner cylinder 16, coaxial with the outer cylinder 14. As shown in FIG. 1, the inner cylinder 16 may extend slightly to the right of the outer cylinder 14. As described in greater detail hereinafter, the inner cylinder 16 is movable with the female contact 10 as the circuit interrupter operates and the outer cylinder 14 is stationary.

The cylinders 14 and 16 define therebetween an annular volume 18. The volume 18 is closed at the left end of the circuit interrupter by facilities (not shown) and is closed at its right end by a piston 20. The piston 20, which is made of an elastomer or a similar material, is carried by support structure, generally indicated at 22, mounted to the inner cylinder 16. The support structure 22 may include a support cylinder 24 having a conical end 26, which is held by a mounting ring 28 to the inner cylinder 16. Passageways 30 through the conical end 26 communicate with both the volume 18 and with a flow volume 32 defined between the right end of the inner cylinder 16 and the support cylinder 24. When the inner cylinder 16 and the piston 20 carried thereby move leftwardly relative to the stationary outer cylinder 14 (or should the outer cylinder 14 move rightwardly), the volume 18 is decreased in size and an arc-extinguishing fluid, for example, gaseous sulfur hexafluoride ($SF_6$), therewithin is compressed. Such compression of the arc-extinguishing gas causes this gas to flow through the passageways 30 and into the flow volume 32.

Gas flowing through the flow volume 32 is selectively directed by a nozzle generally indicated at 34. The nozzle 34 is carried by the inner cylinder 16 and the support cylinder 24. Preferably, the nozzle 34 is made out of an insulative, temperature-resistant material, such as polytetrafluoroethylene, and may have any configuration known in the prior art, the configuration depicted in the FIGURES being exemplary only. Gas forced into the flow volume 32 by the decrease of the volume 18 first flows out of the flow volume 32 and into a channel 36. Upon exiting the channel 36, the gas flows through a throat 38 of another channel 40 and from there to the volume enclosed by the outer insulative housing (not shown) of the circuit interrupter via vents 42. As will hereinafter be described, this type of gas flow is directed at any arc which forms during opening of the circuit interrupter and is often referred to as "double flow" nozzle.

Still referring to FIGS. 1 and 5, the improved female contact 10 of the present invention is used with a more or less standard male contact 44. Referring to FIG. 5, the male contact 44 can be seen to comprise an elongated conductive rod or tube 46 made, for example, of copper and having mounted to its free end an arcing tip 48 made, for example, of copper-tungsten. Preferably, the arcing tip 48 is made of a refractory material so as to be resistant to degradation caused by an arc terminating thereon. The rod 46 and the arcing tip 48 may contain therethrough a continuous passageway 50. In preferred embodiments, the male contact 44 is stationary, while the female contact 10 is movable. Those skilled in the art will appreciate that the male contact 44 may be movable, while the female contact 10 is stationary, or both contacts 10 and 44 may be movable.

Returning now to FIG. 1, the improved female contact 10, according to the present invention, may be seen to include a finger assembly 52. The finger assembly 52 comprises a plurality of elongated, flexible, conductive fingers 54 which are connected to or formed integrally with a short mounting cylinder 56. The fingers 54 and the mounting cylinder 56, which may be made of copper, are mounted to the interior of the inner cylinder 16, for example, by threading together at the area generally designated 58.

The fingers 54 may be formed by making a series of elongated slits or cuts 60 in a metal cylinder, the fingers 54 being defined between the slits or cuts 60. As shown in FIG. 1, the slits or cuts 60 do not extend to the left end of the mounting cylinder 56 so that all of the fingers 54 may be commonly mounted to the inside of the inner cylinder 16.

Figure 2:
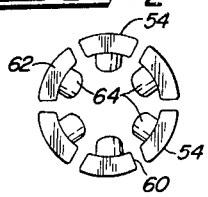
FIG. 2 is an end view of a portion of the improved contact taken generally along line 2—2 in FIG. 1.

Near free ends 62 of the fingers 54, there is centrally attached to each finger 54 a conductive rivet, button or other headed member 64. The conductive rivet 64 may be made of copper having silver plating thereon. The rivets 64 constitute or act as the main current-carrying contact of the female contact 10. To the right of the rivets 64, a peripheral groove 66 is formed in the interior surface of each finger for a purpose to be described below. As can be seen from FIG. 1, the fingers 54 are maintained in an array so that a cavity 68 is defined therebetween. The entrance to the cavity 68 is defined by the free ends 62 of the fingers 54. Thus, the rivets 64 and the grooves 66 are located within the cavity 68, as shown in FIG. 2, and are equidistantly arrayed around a central longitudinal axis 70 of the cavity 68, which axis 70 is also the major axis of the male contact 44.

Figure 4A:
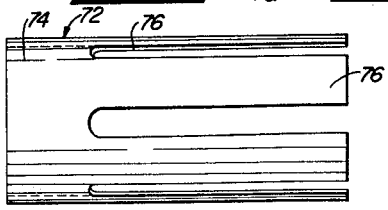
FIGS. 4*a* and 4*b* are, respectively, a side elevation and an end view of biasing facilities utilized with the improved contact of FIG. 1.
Figure 4B:
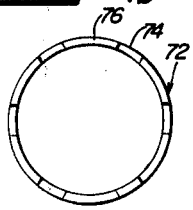

Each of the fingers 54 is biased inwardly by a spring 72. The spring 72 may comprise a mounting cylinder 74 which has formed integrally therewith or attached thereto a plurality of spring fingers 76. The mounting cylinder 74 and the spring fingers 76 may be made of stainless steel or carbon steel. Each spring finger 76 engages the exterior of one finger 54 to bias such finger 54 inwardly toward the axis 70. The mounting cylinder 74 may be fixed in place in any convenient fashion, FIG. 1 depicting the press-fitting of the mounting cylinder 74 into an enlarged diametric portion 78 of the inner cylinder 16. In order to prevent relative longitudinal movement of the mounting cylinder 74 and its spring fingers 76 relative to the inner cylinder 16, a pin 80 may be driven through the mounting cylinder 74 and into the inner cylinder 16. The mounting cylinder 74 and its spring fingers 76 are shown in FIGS. 4(*a*) and 4(*b*). It should be noted that the spring 72 may constitute a furcated, planar member which is rolled into a cylinder having the general configuration depicted in FIGS. 4(*a*) and 4(*b*).

Figure 3:
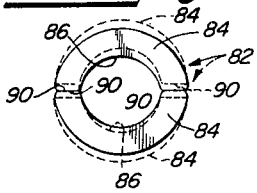
FIG. 3 is an end view of an arcing contact portion of the improved contact taken generally along line 3—3 in FIG. 1.

Referring now to FIGS. 1 and 3, the female contact 10 also includes an arcing contact or tip 82. The arcing contact or tip 82 is made of a refractory material, such as copper-tungsten. As seen in FIGS. 1 and 3, the arcing contact or tip is a pair of generally semi-circular, semi-annular or semi-torroidal members 84. The members 84 define therebetween a passageway 86, which is continuous with the cavity 68. The members 84 are located at or in the vicinity of the free ends 62 of the fingers 54 in the following manner. A peripheral groove 88 is found formed around the exterior of both members 84. The exterior of the members 84 to the left of the grooves 88 are dimensioned to fit into the peripheral groove 66 formed in the fingers 54. The free ends 62 of the fingers 54 are dimensioned to fit into the grooves 88. The members 84 are located in the vicinity of the free ends 62 of the fingers 54, as depicted in FIG. 1, as just described, without any brazing or welding therebetween. The interference provided by the grooves 66 and 88 prevent the members 84 from moving laterally relative to the fingers 54. However, the members 84 can move in and out, toward and away from the axis 72 independently of the fingers 54 due to the fact that they are not brazed or welded to such fingers 54.

Lateral stop surfaces 90 on each member 84 face a respective stop surface on the other member 84. As shown in solid lines in FIG. 3, when the facing stop surfaces 90 abut each other, the members 84 can move no additional amount inwardly toward the axis 70. Accordingly, abutment between the facing stop surfaces 90 sets the maximum amount of movement that can be achieved by the members 84 toward the axis 70.

Referring now to FIGS. 1 and 5, the operation of the female contact 10 is described. In FIG. 1, the contacts 10 and 44 have been separated or disengaged, preferably, as already noted, by movement to the left of the female contact 10 away from the stationary male contact 44. The stop surfaces 90 of the members 84 abut, and the passageway 86 defined therebetween has its smallest diametric dimension. This smallest diametric dimension is achieved by the action of the spring fingers 76 biasing the fingers 54 inwardly, and the fingers 54, in turn, biasing the stop surfaces 90 together. In FIG. 1, the smallest diametric dimension of the passageway 86 is, nevertheless, greater than the diametric dimension between opposed rivets 64 within the cavity 68.

As the contacts 10 and 44 move together, the arcing tip 48 enters the passageway 86. The smallest diametric dimension of the passageway 86 is selected so that entry of the arcing tip 48 into the passageway 86 forces the end surfaces 90 slightly apart and, due to the biasing action of the spring fingers 76 and the fingers 54 on the members 84, results in intimate, sliding engagement between the wall of the passageway 86 and the lateral surface of the arcing tip 48. At this point in time, the diametric dimension of the passageway 86 is still larger than the diametric dimension between the rivets 64, even though the movement apart of the stop surfaces 90 and the concomitant movement apart of the members 84 has moved the fingers 54 slightly away from the axis 70.

Further relative movement together of the contacts 10 and 44 brings first the arcing tip 48 and then the rod 46 of the male contact 44 into intimate, sliding engagement with the rivets 64, again due to the action of the spring fingers 76. As shown in FIG. 5, engagement between the rivets 64 and the arcing tip 48 or the rod 46 of the male contact 44 releases any spring biasing action on the members 84 by the fingers 54 and ensures that the main current path through the circuit interrupter is through the rod 46, the rivets 64, and the fingers 54. That is, when the rivets 64 engage the rod 46, the fingers 54 are moved still farther away from the axis 70, moving the free ends 62 out of engagement with the exterior of the members 84. Thus, the members 84 are "free floating" relative to the axis 70 at this time and the diametric size of the passageway 86 is either equal to or larger than the diametric size of the cavity 68 between the rivets 64, depending on the lateral position assumed by the free-floating members 84, for example, due to gravity or the orientation of the interrupter. Current flows from the fingers 54 to the mounting cylinder 56, and from there to the inner cylinder 16, which is connected at the left end of the circuit interrupter (not shown) to one point of a circuit protected thereby. The stationary male contact 44 is electrically continuous at the other end of the circuit interrupter (not shown) to an opposed point of the protected circuit.

Turning now to FIG. 5, should the contacts 10 and 44 be relatively moved so as to separate, there is initially intimate sliding engagement between the rivets 64 and, first, the rod 46 and, then, the arcing tip 48 of the male contact 44. After the arcing tip 48 passes to the right of the rivets 64 and the fingers, therefore, move toward the axis 70, the biasing action of the spring fingers 76 on the fingers 54 again urges the wall of the passageway 86 against the lateral surfaces of first the rod 46 and then the arcing tip 48. During the time the wall of the passageway 86 intimately engages either the rod 46 or the arcing tip 48, the stop surfaces 90 are separated, as shown in dotted lines in FIG. 3. Following leftward movement of the arcing tip 48 past the members 84, arcing may occur. Because the arcing tip 48 and the members 84 engaged after the rod 46 and the rivets 64 were no longer involved in sliding electrical engagement, any such arcing which occurs will be initiated between the refractory arcing tip 48 and the refractory members 84. As such arcing occurs, gas is flowed by the nozzle 34 at the arc to aid in its ultimate extinguishment.

The structure of the female contact 10 described above has several advantages. First, unlike prior art structures, the arcing contact or tip 82 is not brazed or welded to the fingers 54, but is merely held at or in the vicinity of the free ends 62 thereof by the grooves 66 and 88. Consequently, the assembly of the arcing contact or tip 82 to the fingers 54 is relatively inexpensive and simple to achieve. Second, because no brazing or welding is necessary, the mode of attachment between the arcing contact or tip 82 and the fingers 84 cannot be attacked or degraded by an arc. Specifically, in prior art devices, arcing contacts or tips are brazed or welded to the contact fingers. Should the arc "root" or remain in one spot for too long a time, the brazing or welding may be degraded or destroyed by the heat of the arc and the arcing tip may fall away from the free end of the finger. As a consequence, the fallen-away arcing tip may jam the operation of the circuit interrupter either during closing or opening thereof.

Third, in prior art structures, each finger typically has mounted thereto an arcing tip. Accordingly, should an arc "root" and become stationary on one such tip, the entire tip and its finger are subjected to the heat of the arc, exacerbating the problem described above of the degradation or destruction of the brazed or welded mounting of the arcing tip finger. In the present structure, two members 84 are illustrated and, accordingly, if an arc "roots" on one thereof during separation of the contacts 10 and 44, a greater mass of metal is available for dissipating the heat thereof. Moreover, as already noted, the members 84 are not attached by brazing or welding to the fingers 54, and, accordingly, there is no weld or brazed joint to be attacked by the heat of the arc.

Fourth, in the prior art, the fingers may be formed as described above, that is, by cutting or slitting a conductive tube. This cutting or slitting generally occurs after a ring of refractory metal has been brazed or welded to one end of the cylinder. Following the cutting or slitting, the individual fingers, bearing their individual arcing tips, are formed. This cutting or slitting operation provides a number of sharp edges or corners between the fingers. It is well known that arcs will often "root" or preferentially terminate on such sharp edges or corners. With the arcing contact or tip 82 of the present invention comprising two members 84 which are not brazed or welded to the fingers 54, the members 84 may be smoothed or finished prior to assembly thereof in the vicinity of the free ends 62 of the fingers 54. Accordingly, sharp edges are eliminated. Furthermore, because only two members 84 are used, each member 84 has only two "edges" or "corners"—the stop surfaces 90—other than the major surfaces thereof on which an arc may theoretically "root" or preferentially terminate. The chances that such "rooting" will occur may be decreased substantially by smoothly machining or finishing the stop surfaces 90 so that no sharp edges or corners are present. If an arc does, nevertheless, "root" on one of the stop surfaces 90, or anywhere else on one of the members 84, as already noted, the increased mass of metal relative to the mass of individual arcing tips on individual fingers, as in the prior art, offers a greater chance of safe dissipation of the thermal energy generated by the arc, thereby decreasing the chance of damage to the arcing contact or tip 82.

Fifth, the free-floating nature of the members 84 which make up the arcing contact or tip 82 simplifies and lowers the cost of the assembly of the female contact 10, as described above, and permits either the rivets 64 or the members 84 to selectively, intimately, slidingly engage the male contact 44. Specifically, when the circuit interrupter is closed and is carrying current, the rivets 64 are held in firm mechanical and electrical contact with the rod 46 of the male contact 44 due to the action of the spring fingers 76. The members 84, because they are "free floating" and because of the difference in diametric size of the passageway 86 and that portion of the cavity 68 defined between the rivets 64, only loosely engage, if at all, the rod 46. This is acceptable inasmuch as it is not desired that the arcing contact 82 carry current during the normally closed condition on the circuit interrupter. The arcing tip 48 is maintained out of the main current-carrying path by, as shown in FIG. 5, making the male contact 44 and its rod 46 sufficiently long so that the arcing tip 48 is normally positioned to the left of the rivets 64. During an opening operation of the circuit interrupter, when relative movement occurs between the contacts 10 and 44, the rivets 64 first contact the rod 46 and then contact the arcing tip 48. As the arcing tip 48 moves to the right of the rivets 64, the fingers 54 move inwardly toward the axis 70, permitting the spring fingers 76 to urge the members 84 toward each other so that the wall of the passageway 86 intimately, slidingly engages first the rod 46 and then the arcing tip 48. It is desired that only the arcing tip 48 and the members 84 carry current just immediately before the contacts 10 and 44 separate so that any arcing is initiated therebetween. When the contacts 10 and 44 are moved relatively together during closing of the circuit interrupter, the reverse of the above-described action occurs. Specifically, first the arcing tip 48 and the members 84 engage, after which this engagement is broken (as well as engagement between the members 84 and the rod 46) and the rivets 64 engage the rod 46 to form the sole current path through the interrupter.

In the embodiment of the invention depicted in FIGS. 1 and 5, it is to be noted that the spring 72, including the mounting cylinder 74 and the spring fingers 76, may be replaced by a garter spring or similar spring structure. Further, the number of members 84, while shown as two in number, may be three or more, although two is preferred, in order to minimize the number of stop surfaces 90 on which an arc may tend to "root." Where, as preferred, there are two members 84, each is engageable by one-half of the fingers 54, and the total biasing force on each member 84 is the sum of the total biasing force of each finger 54 engageable with the members 84 times the sine of the angle between a line connecting the stop surfaces 90 and a line drawn from each rivet 64 perpendicularly to the axis 70.

The arcing contact 82 of the present invention also serves an additional function not served by individual arcing tips on individual contact fingers 54 as in the prior art. Specifically, because the arcing contact 82 is made up of the two members 84, inward movement of which toward the axis 70 is limited by abutment of the stop surfaces 90, the members 84 may serve as an anti-collapse ring for the fingers 54. Specifically, in typical prior art female contacts where contact fingers are present, an internal ring or other member must be located within the cavity 68 to prevent the spring 72 or garter spring from moving the fingers 54 so close to the axis 70 as might prevent free entry of the male contact 44 into the cavity 68. The arcing contact 82 of the present invention serves this anti-collapse function and no additional ring or other member need be present within the cavity 68 to prevent the fingers 54 from being moved too close to the axis 70 by the spring fingers 76.

Turning now to FIGS. 6–10, an alternative embodiment of the female contact 10, shown in FIGS. 1 and 5, is shown. To the extent possible, the same or similar elements have been designated by the same or similar reference numerals.

In FIGS. 6–10, the fingers 54 are provided with enlarged, inward protrusions 92, which serve the same functions as the rivets 64 in FIGS. 1 and 5. The arcing contact 82 is similar to that shown in FIGS. 1 and 5, but rather than having the peripheral groove 88 formed in the members 84, each member 84 has formed thereon a peripheral flange 94. Surrounding the fingers 54 is a metal tube 96. Formed in the otherwise closed end 98 of the tube 96 is a hole 100. The hole is aligned with the passageway 86 and the cavity 68. The peripheral flanges 94 of the members 84 are trapped between the closed end 98 of the tube 96 and the left end of the fingers 54. Such trapping of the peripheral flanges 94 prevents or limits longitudinal movement of the members 84 along the axis 70. The spring 72 of FIGS. 1 and 5 is replaced by spring arms 102, which may be formed integrally with or connected to the tube 96, as shown. Each spring arm 102 acts against the outside of one finger 54. Other than these above-described structural changes, the female contact 10 of FIGS. 6–10, as thus far described, is essentially the same as described with reference to FIGS. 1–5.

Figure 6:
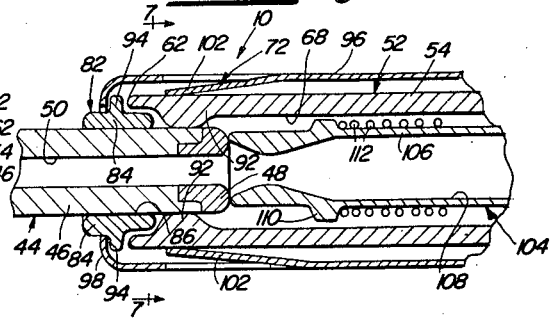
FIG. 6 is a sectioned, side elevation of an improved female contact according to the present invention, which is an alternative to the contact depicted in FIG. 1, the FIGURE showing the alternative contact during its engagement by a male contact, the two contacts both being contained in a high-voltage circuit interrupter.
Figure 8:
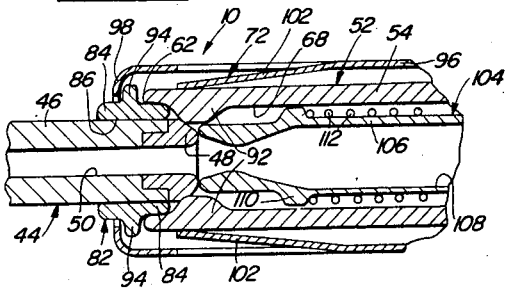
FIG. 8 is a sectioned, side elevation of the contacts depicted in FIG. 6 as such contacts are in the course of separating.
Figure 9:
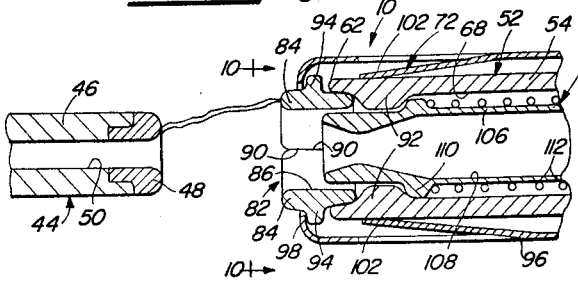
FIG. 9 is a sectioned, side elevation of the contacts shown in FIG. 6 after they have separated.
Figure 10:
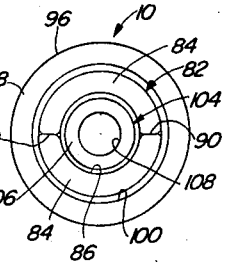
FIG. 10 is an end view of an improved female contact shown in FIGS. 6, 8 and 9 taken along line 10—10 in FIG. 9.

The embodiment of the contact 10 shown in FIGS. 6–10 also includes a follower 104, which is constructed and which operates as described immediately below. The follower 104 comprises a tubular member 106 formed of any convenient material. The tubular member 106 contains a central interior bore 108 and an external collar 110. Acting between the collar 110 and a support member (not shown) to the right of the follower 104 is a coil compression spring 112. The coil compression spring 112 biases the follower 104 to the left. When the circuit interrupter is closed, the contacts 10 and 44 are engaged as depicted in FIG. 6 and the left end of the follower 104 is engaged by the arcing tip 48 and moved slightly rightwardly against the bias of the coil spring 12. As the contacts 10 and 44 begin to open, as depicted in FIG. 8, the left end of the follower 104 remains in abutment with the arcing tip 48 due to the action of the coil spring 112. When the contacts 10 and 44 are separated, as shown in FIG. 9, the follower 104 moves to its maximum leftward extent, at which point the collar 110 abuts the right surfces of the protrusions 92. In this position of the follower 104, the protrusions 92 and, indeed, the majority of the fingers 54 within the cavity 68 are shielded by the tubular member 106. Thus, should an arc, initially formed between the arcing tip 48 and the arcing contact 82, be blown into the passageway 86 or the cavity 68, such arc will not terminate on the fingers 54 or the protrusions 92 thereon. This prevents damage to the fingers 54 and their protrusions 92 by the arc. Furthermore, again as shown in FIG. 9, the bore 108 of the tubular member 106 conducts to the right contaminated arc-extinguishing gas. In the structure of FIGS. 1–5 where the follower 104 is not present, such contaminated gas which contains, among other things, metal vaporized by the arc, might freely mix with the gas being flowed by the nozzle 34, thereby decreasing the ability of the gas to extinguish the arc. Further, in the structure depicted in FIGS. 1–5 where the fingers 54 are defined by the slits 60, even if such contaminated gas does not immediately mix with the gas being flowed by the nozzle 34, it may pass between the fingers 54 and out of the slits 60 and back into the area of the arc to subsequently contaminate the arc-extinguishing gas, thereby reducing its effectiveness in extinguishing the arc. Thus, as shown in FIG. 9, the passageway 86, defined by the members 84 (with the stop surfaces 90 abutting) and the bore 108 of the tubular member 106, constitute, in effect, a nearly continuous conduit which may carry away from the area where arc extinguishment is occurring contaminated arc-extinguishing gas, which is blown into the female contact 10. As should be obvious, the follower 104 may also be used in the embodiment of FIGS. 1–5, with rightward movement of the follower 104 being limited by abutment between the collar 110 and the rivets 64.

I claim:

1. An improved female contact for a circuit interrupter which also includes a male contact; the male contact comprising an elongated conductive rod having a refractory free end which may be telescoped into and out of a male-contact-receiving cavity defined by the female contact when the contacts are relatively moved along coincident longitudinal axes; the female contact including an array of a plurality of parallel, elongated flexible fingers having free ends, the fingers and their free ends defining the cavity, the fingers being spring-biased toward the axes; wherein the improvement comprises:

at least two refractory members located in the vicinity of the free ends of the fingers and defining therebetween a male-contact-engageable, variable size passageway which is continuous with the cavity; the members not being attached to, being free floating laterally of the axes relative to, and being independently movable laterally of the axes with respect to, the fingers; an exterior surface of each member laterally remote from the passageway being engageable by the free end of a least one respective finger;

a pair of lateral stop surfaces on each member, each stop surface on one member facing a respective stop surface on an adjustment member, the facing stop surfaces abutting, when the male contact is out of the cavity and the passageway, due to the engagement of the members by the fingers, such abutment setting the extent of maximum movement of the members toward the axes;

holding means for preventing movement of the members along the axes while permitting the members to move laterally of the axes independently of and freely floating with respect to the fingers; and a male-contact-engageable conductive contact site on each finger remote from the free end thereof and extending toward the axes within the cavity, the diametric size of the cavity between the sites being smaller than the diametric size of the passageway when the male contact is out of the cavity and the passageway and the facing stop surfaces abut, the diameteric size of the cavity between the sites being equal to or smaller than the diametric size of the passageway when the male contact is in the cavity and engages the sites.

2. A contact as in claim 1, wherein:

the holding means comprises a peripheral groove formed in the exterior surfaces of the members to define a raised lip on either side thereof, and a groove formed in the fingers near their free ends within the cavity, one raised lip of each member being loosely held in the groove of some of the fingers and the free ends of some of these fingers being loosely held in the peripheral groove, whereby the members may move toward and away from the axes independently of the fingers while interference between the lips, the grooves, and the free ends of the fingers prevents movement of the members along the axes.

3. A contact as in claim 1, wherein:

the holding means comprises a tube surrounding the fingers, the tube having a closed end and an aperture therethrough aligned with the passageway and the cavity, and a peripheral raised lip on the exterior surface of each member, each raised lip being positioned between the free ends of some of the fingers and the closed end of the tube to limit movement of the members along the axes, the free ends of the fingers being engageable with the exterior surfaces of the members on one side of the lips.

4. A contact as in claim 3, which further comprises a plurality of leaf springs integral with the tube and acting against the fingers to bias the fingers toward the axes.

5. A contact as in claim 1, wherein:

facing stop surfaces are held out of abutment when the male contact is within the passageway.

6. A contact as in claim 5, wherein:

the engagement of the fingers with the exterior surfaces of the members maintains the wall of the passageway in intimate sliding contact with the male contact when the male contact is within the passageway but has not engaged the contact sites.

7. A contact as in claim 6, wherein:

the biasing of the fingers holds the contact sites in intimate sliding engagement with the male contact as and after the male contact enters the cavity, which engagement flexes the fingers away from the axes against the biasing action to disengage the free ends of the fingers from the exterior surfaces of the members following which the members are free-floating toward and away from the axes relative to the free ends of the fingers.

8. A contact assembly which includes the contact of claim 1 and which further comprises:

a closed, hollow tube located in the cavity for longitudinal movement therein, the tube having an open free end abuttable by the free end of the male contact in the cavity;

means for biasing the tube toward the contact sites; and means for limiting movement of the tube toward the contact sites, the presence of the male contact in the cavity holding the tube away from the contact sites, separation of the contacts permitting the biasing means to move the tube toward the contact sites so that the tube shields the contact sites and the fingers within the cavity from any arc initiated between the free end of the male contact and the members.

9. A contact assembly as in claim 8, wherein:

the tube-biasing means comprises an external collar on the tube, and a spring acting against the collar; and the limiting means comprises the collar which is abuttable with the contact sites.

10. A contact assembly as in claim 9, wherein:

the collar is spaced from the free end of the tube.

11. An improved female contact for a circuit interrupter of the type which includes a male contact having a conductive rod with a free end and a first major longitudinal axis, a refractory tip being mounted to the free end of the rod; the female contact including a plurality of elongated, conductive fingers maintained in an array so as to define a tubular cavity having a second major longitudinal axis, the axes being coincident so that the rod and the tip may be telescoped into and out of the cavity as the contacts are relatively moved along their axes; wherein the improvement comprises:

a male-contact-engageable conductive contact site on each finger, each site being positioned longitudinally away from the free end of its finger and being directed toward the second axis within the cavity for slidably engaging the lateral surfaces of the rod and the tip as the contacts are telescoped during relative movement;

means for biasing the fingers toward the second axis, the contact sites and the fingers being moved away from the second axis against the biasing means by engagement of the contact sites with the lateral surfaces of the rod and the tip;

two refractory, semi-torroidal members located at the free ends of the fingers and generally defining therebetween a male-contact-engageable, variable size passageway which is continuous with the cavity, an exterior surface of each member laterally remote from the passageway being engageable by at least one finger when the rod and the tip are not within the passageway;

holding means for preventing movement of the members along the axes while permitting the members to move toward and away from the second axis independently of the fingers; and a pair of lateral stop surfaces on each member, each stop surface on one member facing a respective, abuttable stop surface on the other member, the engagement of the fingers with the exterior surfaces of the members when the rod and the tip are not within the passageway abutting the facing stop surfaces to set the extent of maximum movement of the members toward the second axis and causing the diametric size of the passageway to be greater than the diametric size of the cavity between the sites, entry of the rod and the tip serially into the passageway and the cavity first moving the members apart to disengage the facing stop surfaces while continued engagement of the fingers with the members effects intimate sliding engagement between the wall of the passageway and the lateral surfaces of the tip and the rod and then intimately engaging the contact sites with the lateral surfaces of the tip and the rod to disengage the fingers from the exterior surfaces of the members; exiting of the rod and the tip from the cavity and the aperture first resulting in intimate sliding engagement between the contact sites and the lateral surfaces of the rod and the tip, following which the fingers hold the wall of the passageway in intimate sliding engagement with the lateral surfaces of the rod and the tip to ensure that any arc initiated as the contacts separate terminates on the tip and the members.

12. A contact as in claim 11, wherein:

the holding means comprises a peripheral groove formed in the exterior surfaces of each members to define a raised lip on either side thereof, and a groove formed in the fingers near their free ends within the cavity, one raised lip of each member being loosely held in the groove of some of the fingers and the free ends of some of the fingers being loosely held in the peripheral groove, whereby the members may move toward and away from the second axis independently of the fingers while interference between the lips, the grooves, and the free ends of the fingers prevents movement of the members along the axes.

13. A contact as in claim 12, wherein:

the biasing means comprises a spring acting against the exterior of the fingers remotely from their free ends.

14. A contact as in claim 12, wherein:

abutment of the stop surfaces sets the extent of flexing of the fingers toward the second axis to prevent the biasing means from collapsing the cavity.

15. A contact as in claim 11, wherein:

the holding means comprises a tube surrounding the fingers, the tube having a closed end and an aperture therethrough aligned with the passageway and the cavity; and a peripheral raised lip on the exterior surface of each member, each raised lip being positioned between the free ends of some of the fingers and the closed end of the tube to limit movement of the members along the axes, the free ends of the fingers being engageable with the exterior surfaces of the members on one side of the lips.

16. A contact as in claim 15, wherein:

the biasing means comprises a plurality of leaf springs integral with the tube and acting against the exteior of the fingers.

17. A contact as in claim 15, wherein:

abutment of the stop surfaces sets the extent of flexing of the fingers toward the second axis to prevent the biasing means from collapsing the cavity.

18. An improved female contact for a circuit interrupter which also includes a male contact; the male contact comprising an elongated conductive rod having a refractory free end which may be telescoped into and out of a male-contact-receiving cavity defined by the female contact when the contacts are relatively moved along coincident longitudinal axes; the female contact including an array of a plurality of parallel, elongated flexible fingers having free ends, the fingers and their free ends defining the cavity, the fingers being spring-biased toward the axes; wherein the improvement comprises:

at least two refractory members located in the vicinity of the free ends of the fingers and defining therebetween a passageway which is continuous with the cavity; the members not being attached to, being free floating laterally of the axes relative to, and being independently movable laterally of the axes with respect to the fingers; the exterior surface of each member laterally remote from the passagway being engageable by the free end of at least one respective finger;

a pair of lateral stop surfaces on each member, each stop surface on one member facing a respective stop surface on an adjacent member, the facing stop surfaces abutting when the male contact is out of the cavity and the passageway, due to the engagement of the exterior surfaces of the members by the fingers, such abutment setting the extent of maximum movement of the members toward the axes;

holding means for preventing movement of the members along the axes while permitting the members to move laterally of the axes independently of and freely floating with respect to the fingers; and a male-contact-engageable conductive contact site on each finger remote from the free end thereof and extending toward the axes within the cavity, the diametric size of both the cavity between the sites and the passageway both being smaller than the diametric size of the male contact when the male contact is out of the cavity and the passageway and the facing stop surfaces abut, the diametric size of the passageway being larger than the diametric size of the cavity between the sites when the male contact is out of the cavity and the passageway and the facing stop surfaces abut, the diametric size of the passageway being equal to or larger than the diametric size of the cavity between the sites when the male contact is in the cavity and engages the sites.

19. A female contact as in claim 18, wherein:

the diametric size of the cavity between the sites is smaller than the diametric size of the male contact when the male contact is within the passageway but not in engagement with the sites, the exterior surface of each member is engaged by at least one finger and biased toward the axes when the male contact is out of the passageway and the cavity and when the male contact is in the passageway but not in engagement with the sites, and the members are not biased toward the axes by any finger when the male contact engages the sites, each member being at this time free to move between the fingers and the male contact.

20. A female contact as in claim 19, wherein:

the facing stop surfaces are all in abutment only when the male contact is out of both the cavity and the passageway.

* * * * *